US011725383B2

(12) United States Patent
Fabry et al.

(10) Patent No.: US 11,725,383 B2
(45) Date of Patent: Aug. 15, 2023

(54) METHOD OF MOUNTING A ROOF STRUCTURE

(71) Applicant: SOLETANCHE FREYSSINET, Rueil Malmaison (FR)

(72) Inventors: Nicolas Fabry, Antony (FR); Laurent Hujeux, Paris (FR); Michal Ambor, Paris (FR); Armando Marques Ribeiro Da Cruz, Buc (FR)

(73) Assignee: SOLETANCHE FREYSSINET, Rueil Malmaison (FR)

( * ) Notice: Subject to any disclaimer, the term of this patent is extended or adjusted under 35 U.S.C. 154(b) by 115 days.

(21) Appl. No.: 17/604,637

(22) PCT Filed: Apr. 19, 2019

(86) PCT No.: PCT/IB2019/000421
§ 371 (c)(1),
(2) Date: Oct. 18, 2021

(87) PCT Pub. No.: WO2020/212718
PCT Pub. Date: Oct. 22, 2020

(65) Prior Publication Data

US 2022/0220735 A1 Jul. 14, 2022

(51) Int. Cl.
*E04B 7/14* (2006.01)
*E04H 3/14* (2006.01)

(52) U.S. Cl.
CPC *E04B 7/14* (2013.01); *E04H 3/14* (2013.01)

(58) Field of Classification Search
CPC ..... E04B 7/14; E04B 2009/0492; E04H 3/14; E04H 2003/142–147
See application file for complete search history.

(56) References Cited

U.S. PATENT DOCUMENTS 4,676,032 A * 6/1987 Jutras ..... E04H 15/20 52/2.17
5,526,610 A * 6/1996 Delamare ..... E04H 15/20 52/582.1
7,900,401 B2 * 3/2011 Pedretti ..... E01D 15/122 52/2.13

FOREIGN PATENT DOCUMENTS

CN 1875160 A * 12/2006 ..... E01D 15/122
CN 203626105 U 6/2014
(Continued)

OTHER PUBLICATIONS

Braunholz, "Olympiastadion Munchen", Available online at http://www.stbr.net/content/arbeiten/studieren/muenchen/olympiastadion_muenchen-web.pdf, Jan. 20, 2004, pp. 6-12, Cited In International Search Report.

(Continued)

*Primary Examiner* — Babajide A Demuren
(74) *Attorney, Agent, or Firm* — Hamre, Schumann, Mueller & Larson, P.C.

(57) ABSTRACT

For an enclosure including a ground area (2), a spectator area (3) around the ground area and a plurality of bearing points (12) around and above the spectator area, the method of mounting a roof structure comprises: assembling a tension ring (14) at the level of the ground area, the tension ring comprising at least one first cable extending along the tension ring and a plurality of connectors (15) spaced along the tension ring; attaching a plurality of second cables (13) to the plurality of connectors, each second cable having a first end connected to a respective one of the connectors and extending radially and outwardly from the tension ring, each second cable being associated with a respective one of the bearing points (12); and lifting the tension ring by pulling the connectors (15) by the second cables (13).

15 Claims, 7 Drawing Sheets

(56) References Cited

FOREIGN PATENT DOCUMENTS

| | | | | | |
|---|---|---|---|---|---|
| CN | 108086557 | A | * | 5/2018 | ..... E04B 7/14 |
| CN | 111535491 | B | * | 7/2021 | ..... E04B 7/00 |
| CN | 114562027 | A | * | 5/2022 | |
| FR | 2302959 | A1 | | 10/1976 | |
| WO | 98/45544 | A1 | | 10/1998 | |
| WO | 2010006424 | A1 | | 1/2010 | |

OTHER PUBLICATIONS

International Search Report and Written Opinion; International Patent Application No. PCT/IB2019/000421, dated Jan. 24, 2020 (10 pages).

* cited by examiner

METHOD OF MOUNTING A ROOF STRUCTURE

The present invention relates to roof structures for enclosures such as stadiums, arenas and the like.

BACKGROUND

More particularly, the invention relates to roof structures which include a tension ring made of one or more cables and a plurality of radial cables connected to the tension ring and to bearing points disposed on a compression ring located on the periphery of the enclosure.

FIG. 1 illustrates an arrangement of such a roof structure. The enclosure 1 is shown to have a ground area 2 supporting, for example, a sports field, and a spectator area 3 where stands 4 are disposed to receive seats. In FIG. 1, the vertical axis A is located at the center of the ground area 2. The enclosure 1 may be symmetrically arranged about the axis A.

The enclosure 1 must be open-air when it is used for certain sports, such as football, rugby, etc., which are normally not practiced indoor. Still, most stadiums of a significant size have a roof above the spectator area. While open-air enclosures will be more particularly referred to in the description which follows, it will be appreciated that the method proposed in the present document is also applicable, with similar cable arrangements, to indoor or fully roofed enclosures.

It is desirable that the structure supporting the roof does not include towers, masts or other elements that may block the view of parts of the ground area 2 from some of the seats. Suspended roof structures, and more generally cable-supported structures, can achieve that advantageously.

As illustrated in FIG. 1, a suspended roof structure 10 typically includes:

- a compression ring disposed in periphery of the enclosure 1, for example on top of its outer wall, and bearing on its foundations, bearing points 12 being disposed and spaced apart along the compression ring;
- radial cables 13 fixed at the bearing points 12;
- one or more orthoradial cables forming a tension ring 14 and fixed to the radial cables 13 by connectors 15;
- beams 16 or similar connection members attached to the radial cables 13 and/or the tension ring 14; and
- roof panels 17 attached to the beams 16 and to the compression ring and disposed to cover part or all of the spectator area 3. If the enclosure is open-air, the roof panels 17 typically do not cover the ground area 2, as shown in FIG. 1. They may cover the ground area too in an indoor or fully roofed case.

As shown in FIG. 1, the tension ring is not necessarily at the edge/end of the roof. In case of a fully roofed enclosure, the central area of the tension ring can be spanned with a secondary structure using girders, lattice girders, etc.

Putting in place such a roof structure 10, especially the radial cables 13 and the orthoradial cable(s) forming the tension ring 14, is not an easy task. Generally, the tension ring 14 is assembled on the stands 4. The individual cables forming the tension ring 14 are unwound from a reel held by a crane, in order to assemble the tension ring plumbing from its final position. This prevents the seats and other stands equipment to be installed, and it requires special protective measures for the stands 4. The tension ring 14 is then lifted and the trajectory of the cables may interfere with elements such as barriers, posts or other fixed equipment provided on the stands 4. Temporary support structures, such as scaffoldings, may be used, but they require high-capacity cranes for installing bearing or deviation elements which may be quite heavy.

There is thus a need for a simpler and more efficient method to mount the roof structure.

SUMMARY

There is provided a method of mounting a roof structure for an enclosure, the enclosure including a ground area, a spectator area around the ground area and a plurality of bearing points around and above the spectator area. The method comprises:

- assembling a tension ring at the level of the ground area, the tension ring comprising at least one first cable extending along the tension ring and a plurality of connectors spaced along the tension ring;
- attaching a plurality of second cables to the plurality of connectors, each second cable having a first end connected to a respective one of the connectors and extending radially and outwardly from the tension ring, each second cable being associated with a respective one of the bearing points; and
- lifting the tension ring by pulling the connectors by the second cables.

Assembling the tension ring on the ground area is much simpler than doing it on the stands of the enclosure. The lifting sequence by which the tension ring is raised to its final position can be controlled to avoid interference with the stands and any equipment thereon. The whole procedure is much simpler than prior art procedures, in particular because temporary support structures may be unnecessary.

In an embodiment, a perimeter of the tension ring increases when the tension ring is lifted.

The method may further comprise:

- disposing a third cable along the tension ring at the level of the ground area, such that the perimeter of the tension ring is defined by the third cable; and
- feeding additional length of the third cable along the tension ring when the tension ring is lifted to increase the perimeter of the tension ring.

In this case, the at least one first cable may be disposed in a loose state when the tension ring is assembled at the level of the ground area and become tensioned by the pulling action of the second cables once the perimeter of the tension ring has increased up to a maximum value. The at least one first cable may be disposed to have a sinuous path when the tension ring is assembled at the level of the ground area. The third cable is mounted on deviators attached to a front side of the connectors, i.e. on the radially inner side of the tension ring. Feeding additional length of the third cable along the tension ring may be performed by using a strand jack mounted on the third cable when the third cable is disposed along the tension ring at the level of the ground area.

In another embodiment, the at least one first cable has a plurality of segments following each other along the tension ring and is equipped with couplers for assembling the segments, and at least one of the couplers comprises: a first coupling part attached to an end of a first segment of the at least one first cable and having a first abutment surface; and a second coupling part attached to an end of a second segment of the at least one first cable and having a second abutment surface facing the first abutment surface, the first and second abutment surfaces being brought closer to each other when the tension ring is lifted, for example by using a strand jack connected to the first and second coupling parts.

In an embodiment, lifting the tension ring includes at least one iteration of a first phase of pulling the second cables while keeping a constant perimeter of the tension ring, whereby an inclination angle of the second cables decreases and the tension ring is lifted, followed by a second phase of increasing the perimeter of the tension ring. One way of doing that is by not pulling the second cables in the second phase, whereby an inclination angle of the second cables increases and the tension ring is lowered. In each iteration, the inclination angle of the second cables decreases more in the first phase than it increases in the second phase, and the tension ring is lifted in the first phase more than it is lowered in the second phase.

After the at least one iteration, there may be a final phase of pulling the second cables while keeping a constant perimeter of the tension ring.

In an embodiment, additional cables are disposed across the ground area and connected to the tension ring.

After the tension ring is lifted, the second cables may be anchored, for example at the bearing points. Alternatively, they may be anchored at positions spaced apart from the bearing points and deviated at the bearing points.

Other features and advantages of the method and apparatus disclosed herein will become apparent from the following description of non-limiting embodiments, with reference to the appended drawings.

DESCRIPTION OF EMBODIMENTS

The method described below is for mounting a roof structure 10 of the kind illustrated in FIG. 1 above the spectator area 3 of an enclosure 1 such as an open-air stadium, more particularly for mounting the cable network of the roof structure.

Figure 1:
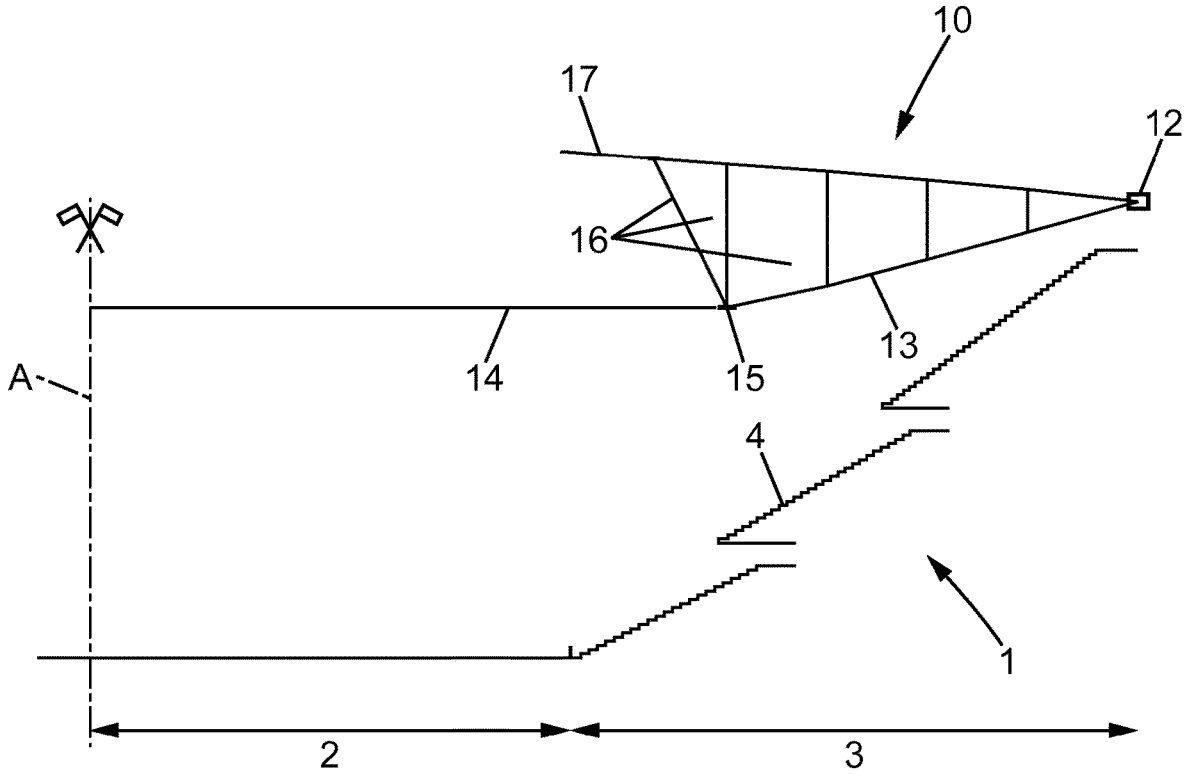
FIG. 1, already discussed above, is a schematic elevation view of a stadium provided with a suspended roof structure.
Figure 2:
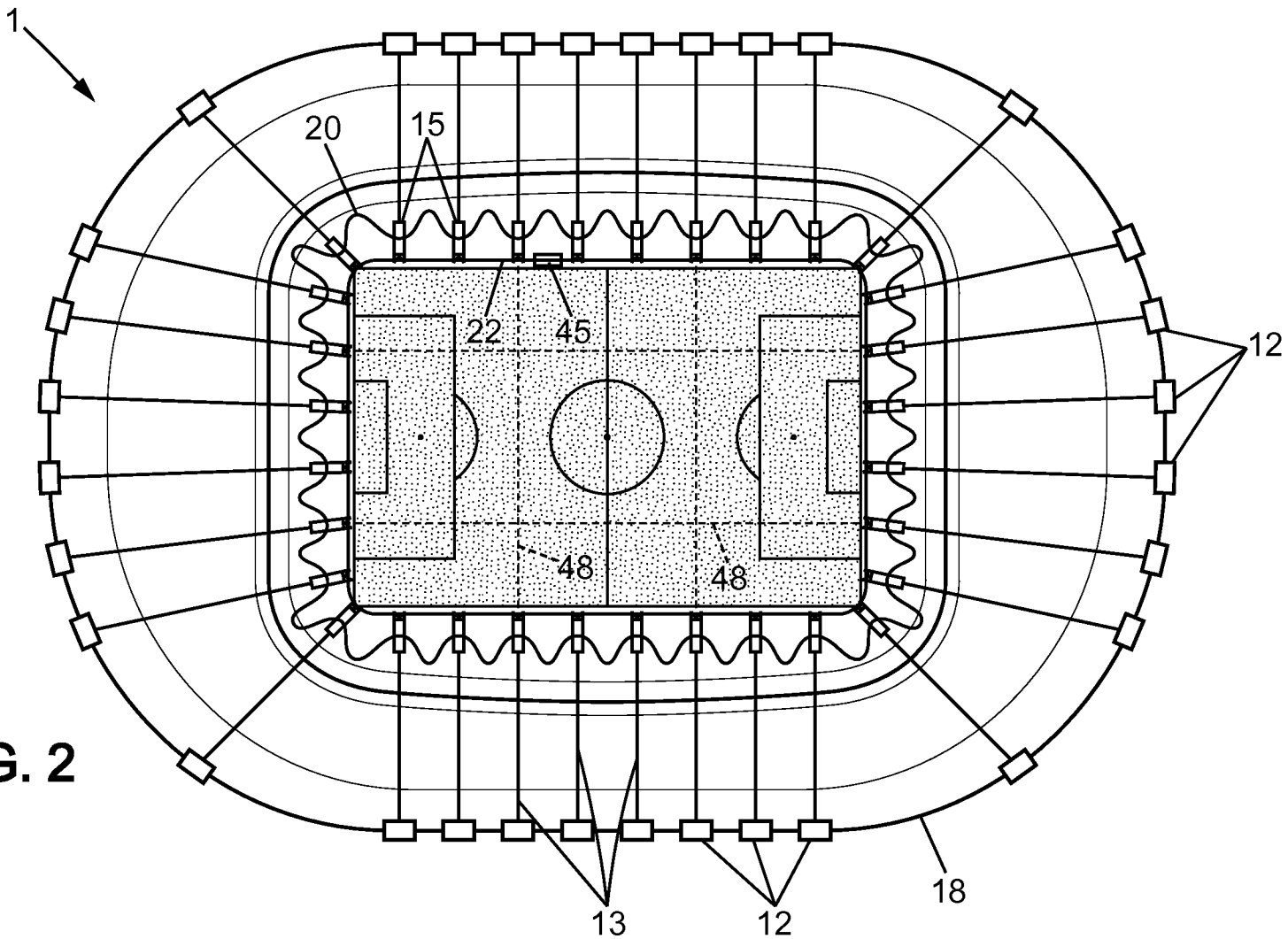
FIG. 2 is a schematic top view of the stadium in a step of assembling a tension ring.

An embodiment of the method is illustrated in FIG. 2, which is a schematic top view of the stadium 1. At the periphery of the stadium, FIG. 2 shows the compression ring 18 along which the bearing points 12 are spaced. Referring also to FIG. 1, the bearing points 12 are located around and above the spectator area 3 which is located around the ground area 2.

A first step of the method consists in assembling the tension ring 14 at the level of the ground area 2. The tension ring as assembled includes one or more cables 20 whose trajectory follows the circumference of the tension ring, the connectors 15 spaced along the circumference of the tension ring and, in the embodiment illustrated by FIG. 2, a temporary cable 22 mounted on the connectors 15. In the description which follows, the cable(s) 20 forming the tension ring 14 are also referred to as "first cable(s)", the radial cables 13 are also referred to as "second cables", and the temporary cable 22 is also referred to as "third cable".

A radial cable 13 is attached to each of the connectors 15 disposed along the circumference of the tension ring 14. The positions of the connectors along the tension ring 14 correspond to the positions of the bearing points 12 along the compression ring 18.

In the schematic illustration of FIG. 2, the tension ring 14 is shown to have a generally rectangular shape. In the final position of the tension ring (FIG. 1), its path, seen from above, will typically be circular, elliptical or oval, with a curvature that varies along its circumference. It is also possible that the final position of the tension ring lies in an inclined (rather than a horizontal) plane. The method described herein is not limited to any specific shape of the tension ring 14 in its initial or final position.

Figure 3:
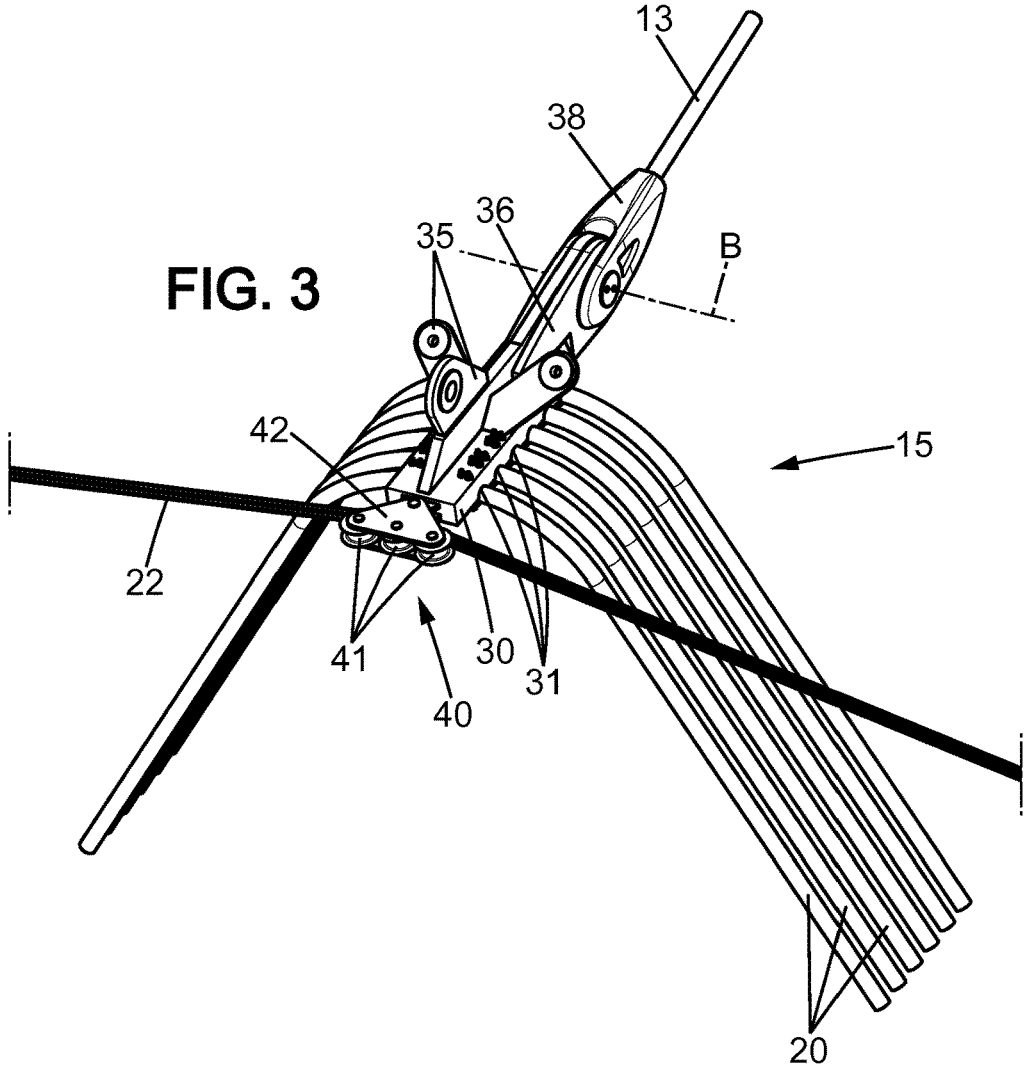
FIGS. 3 and 4 are perspective views of a connector belonging to the roof structure.
Figure 4:
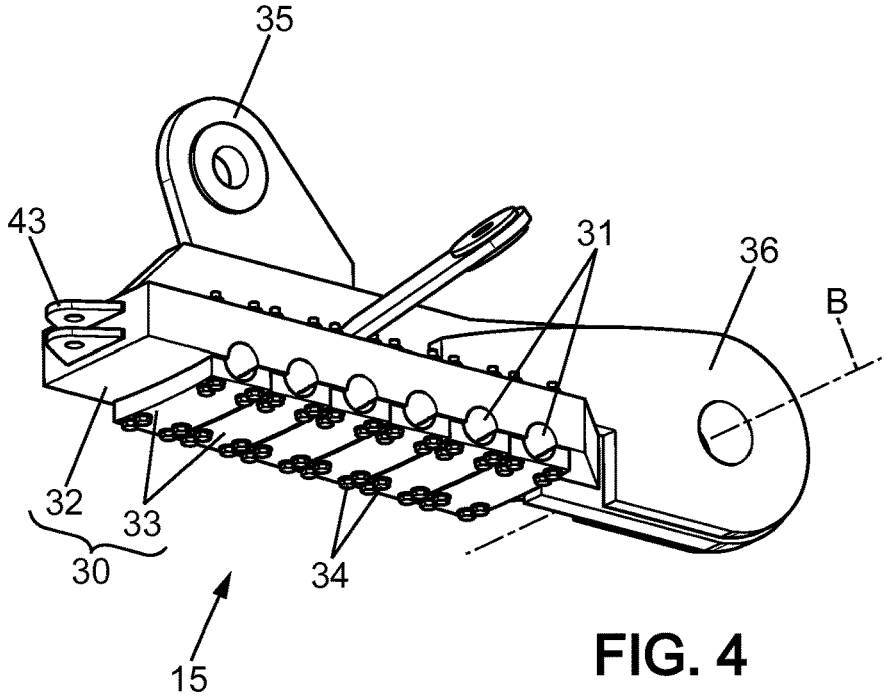

FIGS. 3-4 show a possible configuration of a connector 15 comprising a body 30 having passages 31 for receiving respective first cables 20 of the tension ring. In FIG. 3, the connected cables 20-22 are shown together with the connector 15, while they are not shown in FIG. 4. In this example, there are six passages 31, but the embodiment is not limited to that. The passages 31 are parallel to each other in a same substantially horizontal plane. The body 30 may consist of a main plate 32 having grooves formed on its lower surface and of one or more clamping plates 33 that are fixed to the lower surface of the main plate 32 after insertion of the cables 20 into the grooves so as to complete the passages 31 holding the cables 20. The clamping plates 33 are pressed on the main plate 32, with the cables 20 housed in the passages 31, by means of bolts and nuts 34. The first cables 20 may be pressed tightly in the passages of the connector 15, or they may be allowed to slide in the passages.

Connecting parts such as brackets or lugs 35 may be provided on the body 30 of the connector 15 for fixing beams 16 of the roof structure 10 as shown in FIG. 1.

Figure 7:
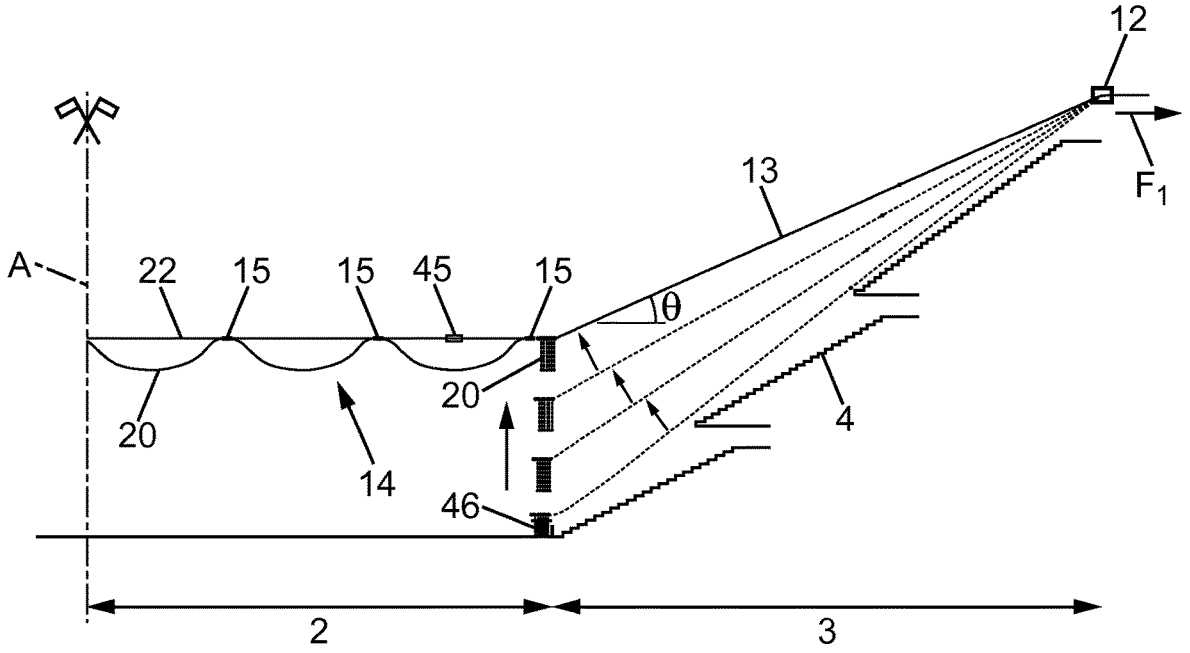

A rear side of the connector 15 includes an extension, such as a lug 36, having a hole along a horizontal articulation axis B for mounting a clevis 38 provided with an anchoring device for attaching one end of a radial cable 13. In the first step of the method, each radial cable 13 attached to a connector 15 is disposed radially from the connector 15 and outwardly from the tension ring 14. The radial cable 13 may be laid on the stands 4 so as to extend upwardly to a corresponding one of the bearing points 12 provided on the compression ring 18. This is best shown in FIG. 7.

A deviator 40 is attached to the front side of the connector 15. In the example shown in FIG. 3, the deviator 40 comprises three sheaves 41 pivotally mounted between a pair of flanges 42 that are pivotally mounted on a front extension 43 of the connector body 30. The flanges 42 are in a plane parallel to the plane defined by the passages of the body 30, e.g. a horizontal plane in which case the pivot axes of the sheaves 41 and the flanges 42 are vertical. The temporary cable 22 is mounted on the deviators 40 of the connectors 15 along the perimeter of the tension ring, to be guided by the sheaves 41.

When it is assembled on the ground area 2, the tension ring 14 has its perimeter defined by the temporary cable 22 (FIG. 2). A tensioning system, such as one or more jacks 45, may be provided on the temporary cable 22 so as to set the length of the perimeter.

Figure 6:
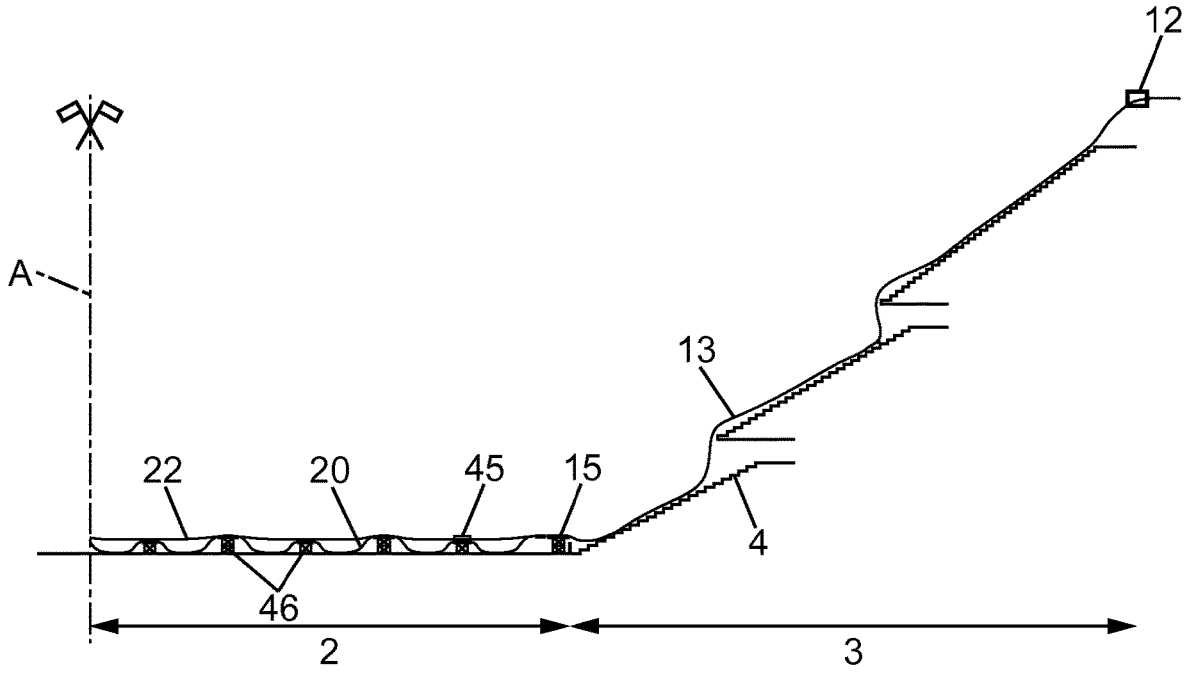
FIGS. 6-10 are diagrams showing cables of the roof structure at different stages of its installation.

The cables 20 are, however, first disposed in a loose state. In particular, the cables 20 can be disposed to have a sinuous path. In FIG. 2, the sinuous path is shown as undulations in a horizontal plane. It may be more convenient to have undulations in a vertical plane as shown in FIG. 6 by disposing small removable supports 46 on the ground at discrete locations along the perimeter of the tension ring and laying the cables 20 alternately on the ground and on the removable supports 46.

It has been mentioned above that the tension ring 14 is assembled at the level of the ground area 2. It means that the cables 20, 22 may be laid directly on the surface of the ground area 2, for example around a football field as shown in FIG. 2, or that they may be laid close to the surface of the field, for example in a shallow trench around the field or on a protective floor disposed on the ground area 2 to avoid damaging the surface of the field with the cables and associated tools. Still, it is not necessary to provide a large supporting structure for assembling the tension ring 14.

The tension ring 14 may include one first cable 20 or a plurality of first cables 20. Each first cable 20 has its two ends anchored so as to be tensioned in the final position of the tension ring 14. The anchoring devices may be collocated with some of the connectors 15 (for example with anchoring jaws inserted in some of the passages 31), or they may be provided by couplers (not shown) separate from the connectors 15.

If there is only one first cable 20, it may be disposed in one or several turns along the tension ring 14, for example six turns if it extends through the six passages 31 shown in FIGS. 3-4. When the full length cannot be provided with one first cable, it may be replaced by a plurality of first cables 20.

When the first cables 20 are plural, they can be connected to each other via couplers in order to follow one or several turns along the tension ring 14, thus forming different cable segments. Another option is to have a number of first cables 20 independent from each other, anchored separately and following concentric paths. Such concentric cables can themselves be made of one or more cable segments.

Likewise, the temporary cable 22 can be provided as one or more segments, and it may follow one or more turns along the tension ring 14.

FIG. 2 shows that, optionally, additional cables 48 may be attached to the tension ring 14 when it still rests on the ground area 2. The additional cables 48 extend across the ground area 2. Each of them may be attached to a pair of connectors 15 located at opposite positions on both sides of the ground area 2. The additional cables 48 may be needed to deal with particular geometries of the roof structure 10. They contribute to stabilizing the tension ring 14 while it is lifted. They may be removed once the roof structure 10 is completed, or left in place.

Figure 5:
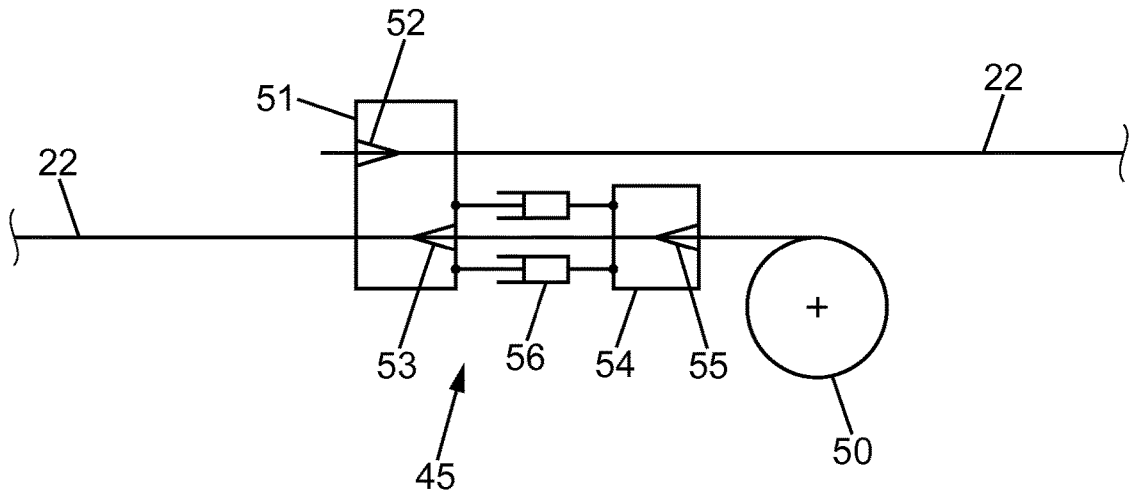
FIG. 5 is a diagram of a temporary cable and elements used to adjust its length.

FIG. 5 shows the temporary cable 22 and a tensioning system used to put it under tension and define the perimeter of the tension ring 14. In this example, the temporary cable 22 is fed from a reel 50 via a strand jack 45. One end of the cable 22 is fixed in an anchor block 51 using a conical jaw 52. From that end, the cable 22 loops around the tension ring 14 and reaches again the anchor block 51, where it is held by another conical jaw 53 on an opposite surface of the anchor block 51. Beyond the anchor block 51, the cable 22 goes through another anchor block 54 before reaching the reel 50. The cable 22 is also held in the other anchor block 54 by means of a conical jaw 55. One or more hydraulic jacks 56 are provided between the two anchor blocks 51, 54. According to the conventional operation of a strand jack, the distance between the two blocks 51, 54 is adjustable by controlling the jacks 56 so as to vary the length of the cable 22 between its two connection points to the anchor block 51 as desired.

In the application considered herein, the strand jack 45 is first controlled to set the perimeter the tension ring 14 by providing the appropriate length of the temporary cable 22. Afterwards, when it is needed to increase the perimeter of the tension ring 14, some additional length of the temporary cable 22 is fed from the real 50 by controlling the strand jack 45.

FIGS. 7-10 illustrate different steps of lifting the tension ring 14 from the configuration shown in FIG. 2 or FIG. 6 to its final position above the stands 4.

Figure 8:
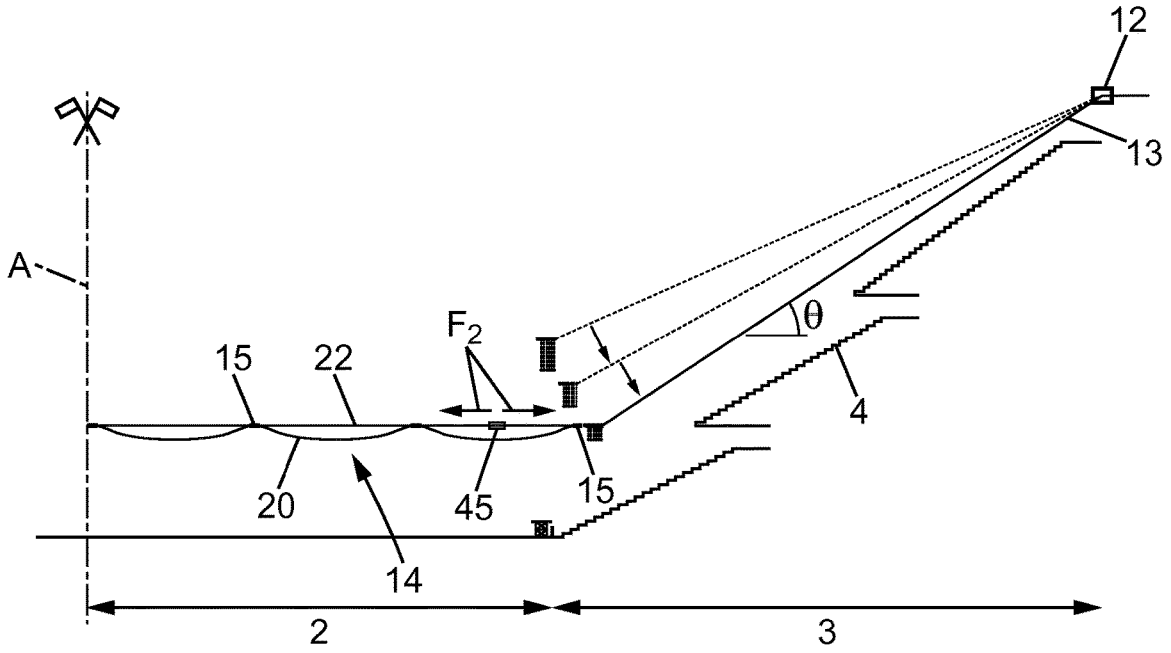

The lifting operation includes:

- a first phase in which the connectors 15 are pulled by the radial cables 13 from the bearing points 12, as indicated by the arrow $F_1$ in FIG. 7, using respective pulling/jacking devices (not shown); and
- a second phase in which the strand jack 45 feeds some additional length of the temporary cable 22 increasing the perimeter of the tension ring 14, as indicated by the arrows $F_2$ in FIG. 8.

In a possible lifting arrangement, each radial cable 13 is fitted in advance with its permanent anchor head (not shown) at a predefined distance from its respective connector 15. The radial cables 13 are pulled outwardly with their anchor heads up to their final positions at the bearing points 12. In such arrangement, each radial cable 13 may be equipped with some extra length beyond the anchor head for applying the required traction force to the radial cable from the bearing point 12. Alternatively, each radial cable 13 may be equipped with a temporary tool cable attached to the anchor head. In both cases, a pulling/jacking device is supported by the compression ring 18 near each bearing point 12. Each bearing point 12 may be provided with an abutment surface against which the anchor head of the respective radial cable 13 is applied at the end of the lifting sequence or alternatively a lug for anchoring a clevis provided as the cable 13 anchor head. Then, inward radial forces are applied at the abutment surfaces of the bearing points 12 by the second cables 13 which behave similarly to spokes of a bike wheel. Such inward radial forces are withstood by the annular shape of the compression ring 18. The bearing points 12 along the compression ring 18 take vertical loads when the tension ring 14 is lifted and then remains in its final position.

In each first phase of the lifting operation (FIG. 7), the perimeter of the tension ring 14 is kept substantially constant, i.e. the strand jack 45 is not activated. Small variations of the perimeter may, however, take place due to the elastic elongation of the cables. The traction applied by the radial cables 13 causes a reduction of their inclination angle $\theta$ while the connectors 15 are lifted vertically. The first cables 20 sag between the connectors once they leave the removable supports 46 and are lifted along with the third cable 22 and the connectors 15 forming the tension ring 14.

In the second phase (FIG. 8), the radial cables 13 are blocked, i.e. the pulling/jacking devices are controlled to prevent their movements at the bearing points 12. The increasing perimeter of the tension ring 14 causes an increase of the inclination angle $\theta$ of the radial cables 13. Thus, the connectors 15 and the tension ring 14 are lowered.

The inclination angle $\theta$ of the radial cables 13 decreases more in the first phase than it increases in the second phase, and the tension ring 14 is lifted in the first phase more than it is lowered in the second phase. Therefore the first and second phases together lead to lifting the tension ring 14 and increasing its perimeter.

Figure 9:
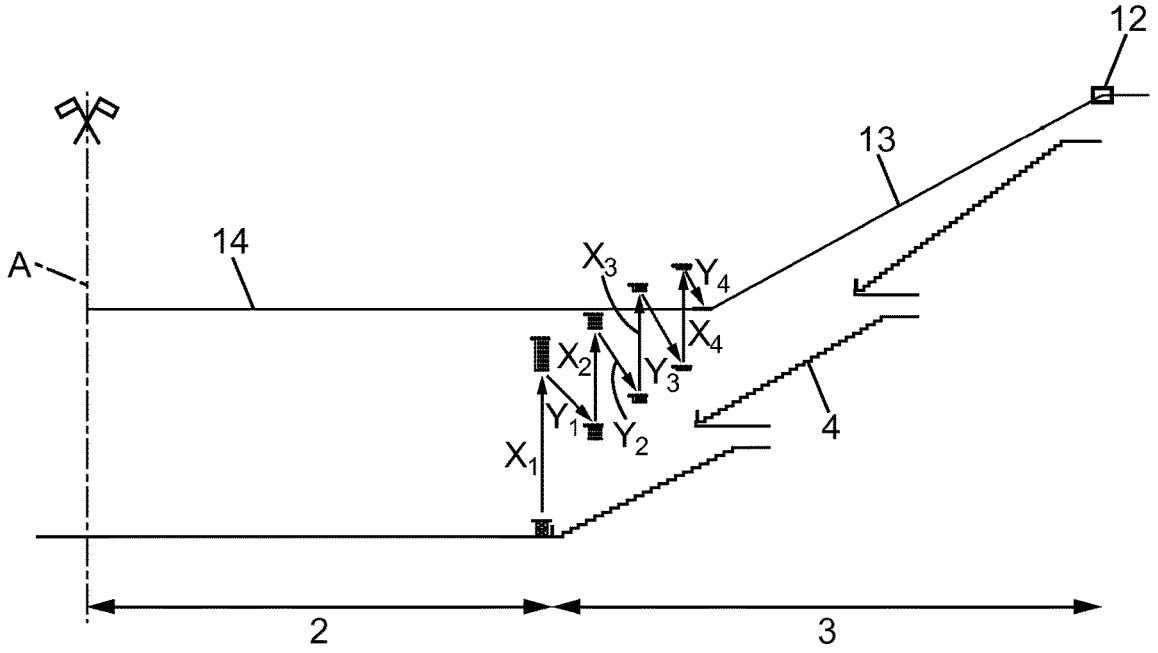

A first phase followed by a second phase as described above will generally not be enough for the tension ring 14 to reach its final position. To continue the lifting operation, first and second phases are iterated. FIG. 9 illustrates a case where a total of four iterations is used. In each iteration i ($1 \leq i \leq 4$), the arrow $X_i$ denotes the lifting of the tension ring 14 with a constant perimeter (first phase), and the arrow $Y_i$ denotes the decrease of the ring perimeter (second phase) that goes with less sagging of the first cables 20 and some lowering of the tension ring.

At the end of the fourth iteration ($Y_4$), the perimeter of the tension ring 14 reaches a maximum value which is the final value that it will have when the roof structure 10 is completed. There is no more sagging of the first cables 20 which have become tensioned by the pulling action of the radial cables 13.

Figure 10:
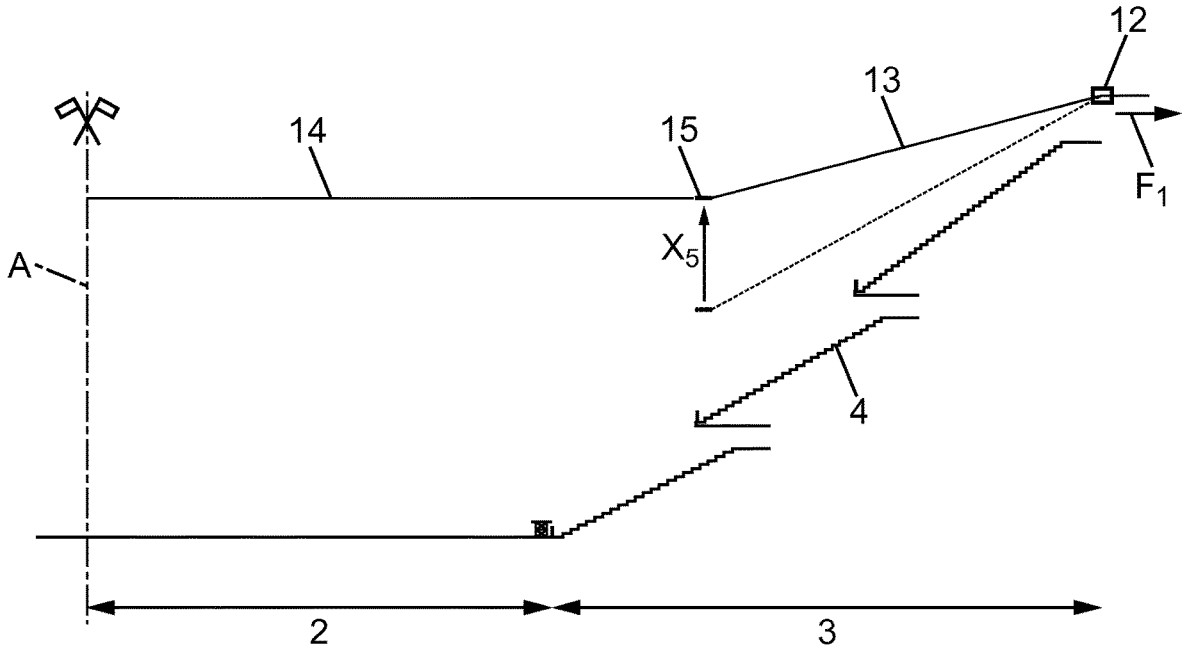

A final lifting phase $X_5$ is performed by pulling the radial cables as shown in FIG. 10 to bring the tension ring 14 to its final position.

The radial cables 13 are then anchored, and the other elements 16, 17 of the roof structure 10 (FIG. 1) are subsequently installed. The temporary cable 22 can be removed, as well as the deviators 40, but alternatively they can also be left in place.

The locations where the radial cables 13 are anchored may be at the respective bearing points 12, provided with abutment surfaces as mentioned above or alternatively with lugs for anchoring devises provided as anchor heads for the cables 13.

In another embodiment, the bearing points 12 have saddle configurations where the radial cables 13 are deviated and the positions of the pulling/jacking devices may be separate from the bearing points 12. The abutment surfaces receiving the anchor heads can then be beyond the bearing points 12, for example in the periphery of the enclosure, lower than the bearing points 12 where the cables 13 are deviated. Alternatively, the radial cables 13 are not pre-equipped with anchor heads. They are pulled in the first phases of the lifting operation and eventually blocked in respective anchor heads fixed to the structure of the enclosure.

The number of iterations to lift the tension ring depends on the geometry and constructional constraints of each worksite. In general, the lifting operation will start with a first pulling phase to secure tension of the temporary cable 22 and to clear the stands 4 from the radial cables 13. After that, one or more iterations are performed.

In each pulling phase $X_1, X_2, \ldots$, the displacements of the radial cables 13 pulled from the bearing points 12 are selected based on the geometries of the tension ring 14 in its original position on the ground and its final, elevated position.

Another possibility is to control the pulling/jacking devices to pull the radial cables 13 continuously at the same time as the ring perimeter is progressively increased.

Another embodiment of the method proposed herein does not make use of a temporary cable 22. The first cables 20 have a plurality of cable segments following each other along the tension ring 14. Couplers are used for assembling the segments, and one or more of the couplers are arranged to allow an increase of the perimeter of the tension ring. In this case, it is not necessary to provide a sinuous path of the first cables 20 around the tension ring. The first cables 20 are tensioned as soon as the lifting operation begins and they do not sag significantly when the tension ring is lifted.

Figure 11:
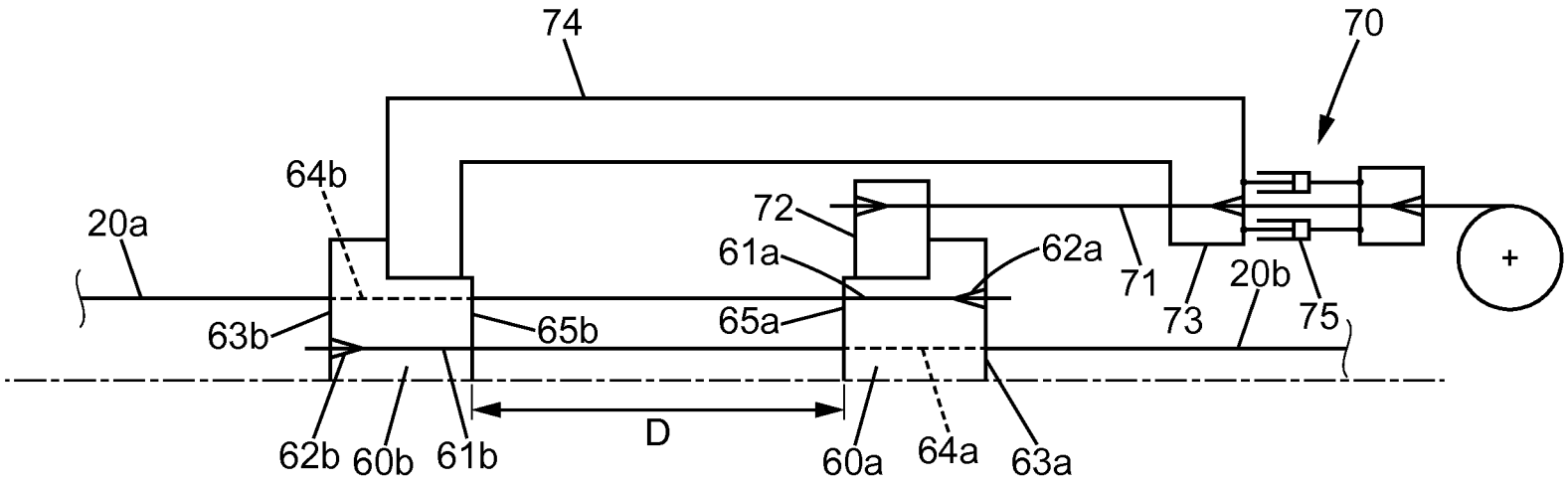
FIG. 11 is a diagram illustrating an alternative embodiment of an assembly of cable segments forming a tension ring.

An example of a coupler usable in such an embodiment is shown schematically in FIG. 11. The coupler has a first coupling part formed by an anchor block 60*a* where an end of a first cable segment 20*a* of the tension ring 14 is attached. A second coupling part of the coupler is formed by an anchor block 60*b* where an end of a second cable segment 20*b* of the tension ring 14 is attached. Each anchor block 60*a*, 60*b* has a first channel 61*a*, 61*b* where its respective cable segment 20*a*, 20*b* is received and anchored by means of a conical jaw 62*a*, 62*b* inserted from an anchoring surface 63*a*, 63*b*. Each anchor block 60*a*, 60*b* also has a second channel 64*a*, 64*b* where the other cable segment 20*b*, 20*a* is received and allowed to slide. The anchor blocks 60*a*, 60*b* have respective abutment surfaces 65*a*, 65*b* facing each other, on opposite sides of their anchoring surfaces 63*a*, 63*b*. When the tension ring 14 is assembled on the ground area 2, a distance D is maintained between the two abutment surfaces 65*a*, 65*b*. When the tension ring 14 is lifted, the distance D is adjusted to be reduced so as to increase the perimeter of the tension ring. At the end, the abutment surfaces 65*a*, 65*b* can be in contact (D=0), or a spacer can be inserted between them (D>0).

Several pairs of cable segments can be attached to the anchor blocks 60*a*, 60*b* of the coupler, though only one pair 20*a*, 20*b* is shown in FIG. 11.

For controlling the distance D and, thus, the perimeter of the tension ring 14, a strand jack arrangement 70 may be used. One or more auxiliary cables 71 are fixed on blocks 72, 73 that bear on the anchor blocks 60*a*, 60*b* of the coupler. In the example shown in FIG. 11, the block 73 bears on the anchor block 60*b* via a compression leg 74. The length of the auxiliary cables 71 between the two blocks 72, 73 is controlled by the hydraulic jacks 75 of the strand jack arrangement 70 similarly to what has been described above with reference to FIG. 5.

It will be appreciated that the embodiments described above are illustrative of the invention disclosed herein and that various modifications can be made without departing from the scope as defined in the appended claims.

The invention claimed is:

1. A method of mounting a roof structure for an enclosure, the enclosure including a ground area, a spectator area around the ground area and a plurality of bearing points around and above the spectator area, the method comprising:

assembling a tension ring at the level of the ground area, the tension ring comprising at least one first cable extending along the tension ring and a plurality of connectors spaced along the tension ring;

attaching a plurality of second cables to the plurality of connectors, each second cable having a first end connected to a respective one of the connectors and extending radially and outwardly from the tension ring, each second cable being associated with a respective one of the bearing points; and lifting the tension ring by pulling the connectors by the second cables.

2. The method as claimed in claim 1, wherein a perimeter of the tension ring increases when the tension ring is lifted.

3. The method as claimed in claim 2, further comprising:

disposing a third cable along the tension ring at the level of the ground area, such that the perimeter of the tension ring is defined by the third cable; and feeding additional length of the third cable along the tension ring when the tension ring is lifted to increase the perimeter of the tension ring.

4. The method as claimed in claim 3, wherein the at least one first cable is disposed in a loose state when the tension ring is assembled at the level of the ground area and becomes tensioned by the pulling action of the second cables once the perimeter of the tension ring has increased up to a maximum value.

5. The method as claimed in claim 4, wherein the at least one first cable is disposed to have a sinuous path when the tension ring is assembled at the level of the ground area.

6. The method as claimed in claim 3, wherein the third cable is mounted on deviators attached to front sides of the connectors.

7. The method as claimed in claim 3, wherein feeding additional length of the third cable along the tension ring is performed by using a strand jack mounted on the third cable when the third cable is disposed along the tension ring at the level of the ground area.

8. The method as claimed in claim 2, wherein the at least one first cable has a plurality of segments following each other along the tension ring and is equipped with couplers for assembling the segments, wherein at least one of the couplers comprises:

a first coupling part attached to an end of a first segment of the at least one first cable and having a first abutment surface;

a second coupling part attached to an end of a second segment of the at least one first cable and having a second abutment surface facing the first abutment surface, wherein the first and second abutment surfaces are brought closer to each other when the tension ring is lifted.

9. The method as claimed in claim 8, wherein the first and second abutment surfaces are brought closer to each other by using a strand jack connected to the first and second coupling parts.

10. The method as claimed in claim 1, wherein lifting the tension ring includes at least one iteration of a first phase of pulling the second cables while keeping a constant perimeter of the tension ring, whereby an inclination angle of the second cables decreases and the tension ring is lifted, followed by a second phase of increasing the perimeter of the tension ring.

11. The method as claimed in claim 10, wherein the second cables are not pulled in the second phase, whereby an inclination angle of the second cables increases and the tension ring is lowered, and wherein, in each iteration, the inclination angle of the second cables decreases more in the first phase than it increases in the second phase, and the tension ring is lifted in the first phase more than it is lowered in the second phase.

12. The method as claimed in claim 10, further comprising, after the at least one iteration, a final phase of pulling the second cables while keeping a constant perimeter of the tension ring.

13. The method as claimed in claim 1, wherein additional cables are disposed across the ground area and connected to the tension ring.

14. The method as claimed in any claim 1, wherein after the tension ring is lifted, the second cables are anchored at the bearing points.

15. The method as claimed in claim 1, wherein after the tension ring is lifted, the second cables are anchored at positions spaced apart from the bearing points and deviated at the bearing points.

* * * * *